United States Patent [19]

Wheeler et al.

[11] 4,068,284

[45] Jan. 10, 1978

[54] CORONA DISCHARGE DEVICE

[75] Inventors: Stanley C. Wheeler, Ross-on-Wye; Peter M. Thorp, Lydbrook, both of England

[73] Assignee: Xerox Corporation, Stamford, Conn.

[21] Appl. No.: 702,375

[22] Filed: July 2, 1976

Related U.S. Application Data

[63] Continuation of Ser. No. 494,648, Aug. 5, 1974, abandoned.

[30] Foreign Application Priority Data

Sept. 28, 1973 United Kingdom ..... 45431/73

[51] Int. Cl.[2] ..... H05F 3/06

[52] U.S. Cl. ..... 361/230; 361/213; 361/229

[58] Field of Search ..... 361/213, 214, 220, 229, 361/230

[56] References Cited

U.S. PATENT DOCUMENTS

| | | | |
|---|---|---|---|
| 2,207,677 | 7/1940 | Chapman | 361/213 |
| 3,932,877 | 1/1976 | Ohnishi | 361/213 |

*Primary Examiner*—Harry E. Moose Jr.

[57] ABSTRACT

An electrical discharge device comprising an insulated conductor adapted to carry a high alternating voltage and an uninsulated conductor encircling the insulated conductor.

1 Claim, 3 Drawing Figures

CORONA DISCHARGE DEVICE

This is a continuation, of application Ser. No. 494,648, filed Aug. 5, 1974, now abandoned.

BACKGROUND OF THE INVENTION

This invention relates to electrical discharge devices.

Once a dielectric material carries an electrical charge, whether generated by electrical induction or applied by a charging device, it is difficult to discharge the dielectric material so that it will not be attracted electrostatically to other bodies.

An electrical discharge device which has been proposed for discharging a sheet of paper passing beneath it comprises an insulated conductor carrying a high alternating voltage, the conductor being provided with a number of spikes extending towards the path of the paper, the spikes being conductive and capacitatively coupled to the conductor. Electrical discharges from the spikes cause the paper to be discharged as it passes the device. Such a device is unsatisfactory because an operator who touches the spikes during operation may receive an electrical shock. Furthermore, the device is expensive to manufacture.

SUMMARY OF THE INVENTION

According to one aspect of the present invention there is provided an electrical discharge device comprising an insulated conductor adapted to carry a high alternating voltage, and an uninsulated conductor encircling said insulated conductor and having a radius of curvature at at least one point in the periphery of its cross-section smaller than the insulated conductor. The invention also includes an electrostatographic reproduction machine comprising a feed path for sheets of transfer material and a device as described above mounted adjacent the feed path.

According to another aspect of the invention, there is provided a method of discharging a dielectric body comprising moving the body relative to a device as set out in the preceding paragraph and applying a high alternating voltage to the insulated conductor and connecting the uninsulated conductor to earth.

The uninsulated conductor may be circular or it may have a cross-section whose periphery has the small radius of curvature at one point only. In use, uninsulated conductor is earthed. The small radius of curvature concentrates the electrical lines of force which in operation are present between the earth conductor and the insulated conductor carrying the high alternating voltage, and at sufficient concentration the surrounding area will be ionized and caused to break down so as to provide a useful discharge path for charge on the dielectric material to be discharged to reach earth through the uninsulated conductor.

The uninsulated conductor may encircle the insulated conductor in helical form, and may be retained in position on the insulated conductor by an insulating sleeve which has a slot which can be arranged to face the material to be discharged.

DESCRIPTION OF THE PREFERRED EMBODIMENTS

Figure 1:
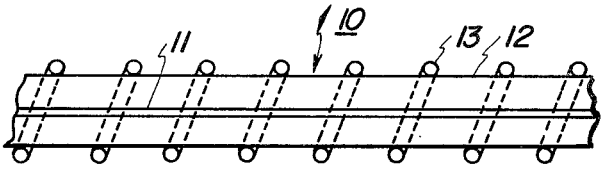
FIG. 1 illustrates the discharge device of the present invention.

The illustrated discharge device 10 comprises a standard high voltage cable, comprising a conductor 11 sheathed in insulation 12, and around the insulation is wound a stainless steel uninsulated wire 13. The wire has a typical diameter of about 0.004 inches, and is wound as a helix of about one half inch pitch. The high voltage cable has a typical diameter of about ⅛ inch.

In operation, the discharge device 10 is mounted by support across a conveyor 21 for a sheet of paper 22 to be discharged at a spacing of about one half inch above the path of the paper. The discharge device 10 extends across the whole width of the paper to be discharged. In operation, the high voltage cable is supplied with an alternating potential of about 7 kilovolts at 50 cycles, and the stainless steel wire 13 is connected to earth.

A test was carried out using the discharge device 10 in such an operational arrangement measuring the potential on a piece of paper which had been charged by a corona discharge device before and after being transported past the discharge device. Before using the discharge device, the paper potential was about 750 volts, and after using the discharge device the potential of the paper was reduced to 50 volts.

Figure 2:
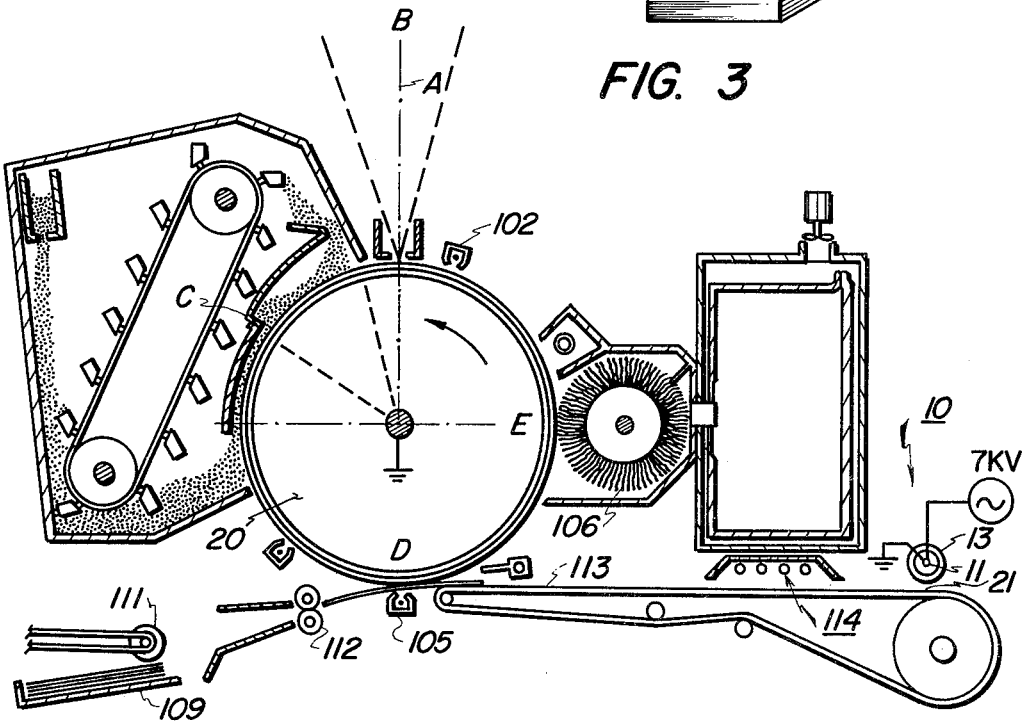
FIG. 2 illustrates a suitable location for the discharge device in a copying machine.

The present invention can be applied to electrostatographic copying machines in which sheets of paper are fed along feed paths and tend to adhere to their conveyors either because electrical charges have been induced in the paper or because electrical charges have been applied to the paper. It is most important that the operator cannot receive a shock from the discharge device when attempting to free any paper jams or when feeling for the next sheet to emerge along the feed path. A suitable position for such electrical discharge devices would be immediately downstream of a device for feeding sheets from a stack in which the rubbing of the sheets as they are separated from the stack would cause electrical charges to be induced in the sheets, which unless discharged might cause the sheets to adhere to a conveyor and not pass from the conveyor to a further guide along the feed path for the sheets. FIG. 2 illustrates another suitable location for the discharge device, adjacent the output for the sheets on which copies have been formed.

In FIG. 2, sheets of paper are fed by feed roller 111 from a tray 109 along a feed path to be driven by pinch rollers 112 to the transfer station D adjacent the xerographic drum 20. The drum 20 passes in sequence from the charging station A at which a corona discharge device 102 applies a uniform charge, an exposure station B at which a latent electrostatic image is formed by projecting an optical image on to the drum, a developer station C at which developer material is cascaded over the drum and adheres to the charged portion of the image, the transfer station D and a cleaning station E at which a brush 106 cleans residual toner from the drum.

At the transfer station D, a corona discharge device 105 applies charge to the reverse side of the sheet in order to attract the developed image on to the sheet. The sheet then passes along the conveyor 113 past the fuser 114 where the developed image is fused into the paper and then to the output of the machine. It is important that any electrical charges remaining on the sheet from the transfer station should be discharged, as such charges will affect the subsequent handling of the sheet, for example, in stacking the finished sheets in an output tray. In the event of a paper jam in the region of the discharge device, it would be impossible for the operator to receive an electrical shock from the discharge device since the part of the device which he would be likely to touch would be stainless steel wire which in operation is connected to earth.

Figure 3:
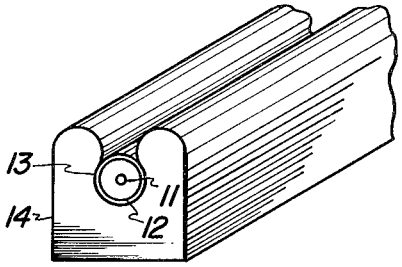
FIG. 3 illustrates an alternate support arrangement for the discharge device.

If the high voltage cable of the device 10 does not have sufficient inherent rigidity to extend across the sheet feed path at constant height, the cable can be mounted in a dielectric support bar 14 as illustrated in FIG. 3. The support bar is formed with a groove for the cable, the walls of the groove serving to locate the stainless steel wire in position around the cable and the mouth of the groove facing the path of the body to be discharged. An alternative arrangement for keeping the stainless steel wire in position is an insulating cover partially encircling the wire around the cable, the cover being formed from a sleeve with a slot formed along it or by a channel-shaped extrusion.

For convenience, the discharge device may have a high voltage cable which extends in an elongated loop from one end of the device across to the other end, doubling back on itself to the first end. All connections to the conductor can be made at the first end.

What is claimed is:

1. An electrical discharge device comprising an insulated conductor adapted to carry a high alternating voltage, an uninsulated conductor encircling said insulated conductor, an insulating support for said conductors, the support being formed with a channel along which the insulated conductor is laid and whose walls retain the uninsulated conductor on the insulated conductor.

* * * * *